US006409068B1

(12) United States Patent
Lee

(10) Patent No.: US 6,409,068 B1
(45) Date of Patent: Jun. 25, 2002

(54) QUICK DETACHABLE FASTENER COVER STRUCTURE FOR FASTENING TOOL

(76) Inventor: Yun Chung Lee, No. 181, Shin-Yi Rd., Ba-Li Shiang, Taipei Hsien (TW)

( * ) Notice: Subject to any disclaimer, the term of this patent is extended or adjusted under 35 U.S.C. 154(b) by 0 days.

(21) Appl. No.: 09/996,428

(22) Filed: Nov. 21, 2001

(51) Int. Cl.[7] ..... B25C 1/04
(52) U.S. Cl. ..... 227/123; 227/127
(58) Field of Search ..... 227/120, 123, 227/127, 128, 136

(56) References Cited

U.S. PATENT DOCUMENTS 4,436,236 A * 3/1984 Jobe ..... 227/123
4,688,710 A * 8/1987 Massari, Jr. et al. ..... 227/120
5,642,849 A * 7/1997 Chen ..... 227/127
6,056,182 A * 5/2000 Chen ..... 227/128
6,076,722 A * 6/2000 Huang ..... 227/127
6,318,618 B1 * 11/2001 Jen ..... 227/123
6,325,268 B1 * 12/2001 Liang ..... 227/123

* cited by examiner

*Primary Examiner*—Scott A. Smith
(74) *Attorney, Agent, or Firm*—Pro-Techtor International Services

(57) ABSTRACT

A quick detachable fastener cover structure for a fastening tool comprising on the head of the fastening tool a cover plate, a housing, a pusher rod etc., wherein: the housing is fixed on the cover plate, and is provided with an engaging plate having a locking hoop, the cover plate is provided with a plurality of hooks and tenons; the guide plate is provided with engaging portions to engage the hooks on the cover plate; the guide plate has thereon a hook seat with a back hook and slide grooves to respectively receive the tenons and engage the locking hoop; the pusher rod is extended between the cover plate and the housing in order that it synchronically move with a safe slide rod on the guide plate; thereby a user needs only to simply move the engaging plate to in turn move the cover plate, and the cover plate on the guide plate can be quickly and tightly connected with or separated from the guide plate.

5 Claims, 6 Drawing Sheets

QUICK DETACHABLE FASTENER COVER STRUCTURE FOR FASTENING TOOL

BACKGROUND OF THE INVENTION

1. Field of the invention

The present invention is related to a fastener cover structure for a fastening tool; and especially to such a structure provided between a guide plate on the head of the fastening tool and a fastener cartridge to protect the track for shooting a fastener, so that when the fasteners to be shot on the track are jammed, the fastener cover structure can be quickly detached to remove the jamming fasteners.

2. Description of the Prior Art

A fastening tool is a tool to shoot the internal fasteners by strong force with a high-pressure air-driven fastener shooting rod, wherein, the head of the tool is provided with a guide plate for a track, the bottom of the guide plate has a fastener cartridge. By discharging the fasteners from the fastener cartridge to be carried by the track, and by protecting of the fastener cover plate on the guide plate, fastener shooting by the forceful fastener shooting rod can be propitious in fastening workpieces such as those of wood stuff.

A fastening tool is always used in a bad environment with dust floating in the air, this renders the dust to attach to the fastener shooting track, thereby, the fasteners to be shot are jammed in the track, and a fault in fastener jamming is resulted. However, by virtue that most conventional fastening tools are connected with their fastener cover plates on their guide plates with a plurality of screws, when jamming occurs, the screws must be detached before the cover plates are detached to remove the jamming fasteners, such operation of removing is extremely inconvenient. Moreover, some techniques of providing quick detaching structures are disclosed in the art, while components of such structures are overly complicated, detachment and assembling are not so easy, and those exposed portions are subjected to being attached with dust, and even abrupt shooting may result when some components are inadvertently touched, hence they have latent danger of hurting people, and thereby are not desired.

Therefore, the inventor of the present invention provides a quick detachable fastener cover structure for a fastening tool after hard study based on his specific experience of years in development of the pneumatic tools.

SUMMARY OF THE INVENTION

The object of the present invention is to provide a quick detachable fastener cover structure for a fastening tool, the structure is characterized in simplifying and having the quick detaching components in a cover plate for preventing dust, and is safe as well as convenient in the operation of detachment and assembling.

In practicing the present invention, a guide plate on the head of the fastening tool is provided with the cover plate, and a housing, a pusher rod and a hook seat on the guide plate. In order to explain the present invention in a more detailed way, a preferred embodiment of the present invention will be described in reference to the accompanying drawings.

DETAILED DESCRIPTION OF THE PREFERRED EMBODIMENT

Figure 1:
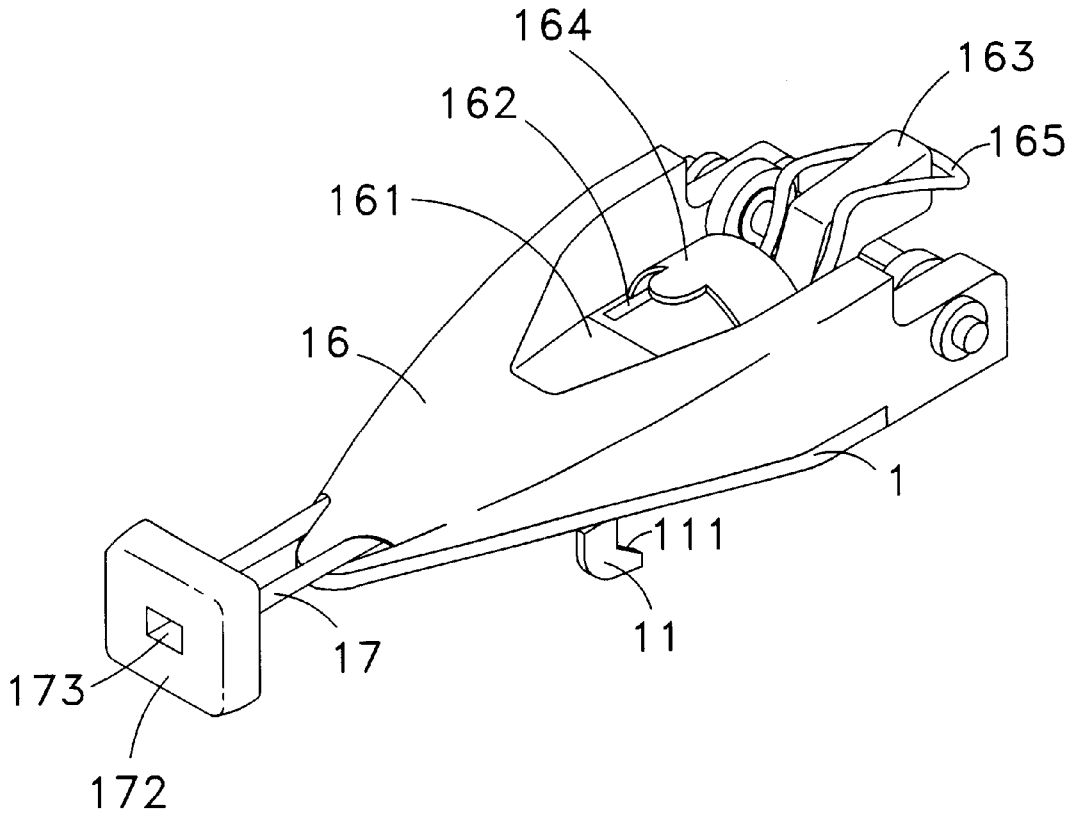
FIG. 1 is a perspective view showing connecting of a cover plate and a housing of the present invention.
Figure 6:
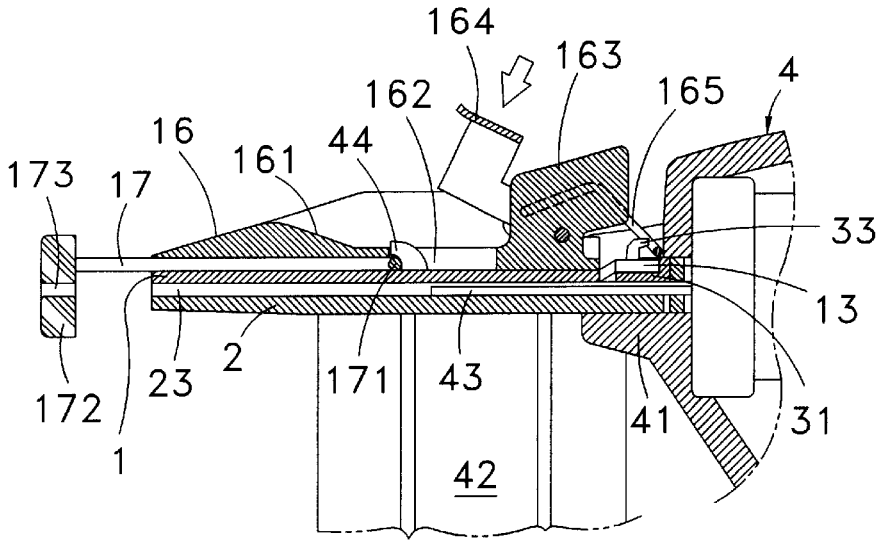
FIG. 6 is a sectional view showing combination of the present invention.

Referring to FIGS. 1 and 6, the quick detachable fastener cover structure for a fastening tool of the present invention mainly is comprised of a cover plate 1, a housing 16, a pusher rod 17 on a guide plate 2 of the head 41 of the fastening tool 4.

Figure 2:
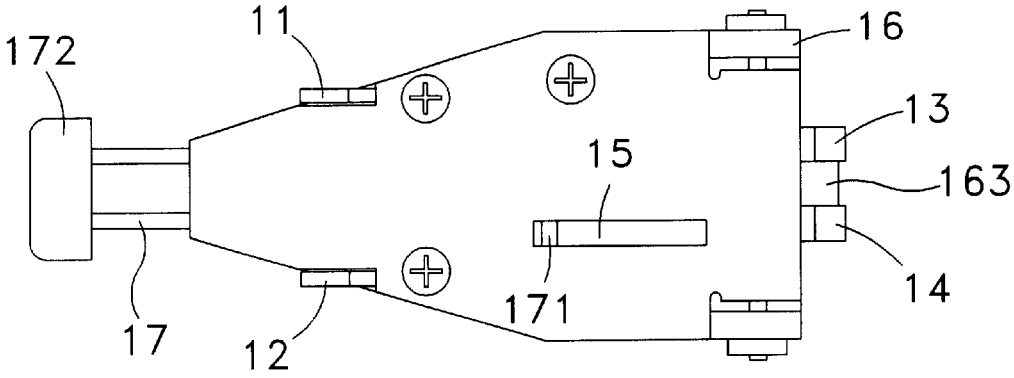
FIG. 2 is bottom view of the cover plate shown in FIG. 1 of the present invention.
Figure 3:
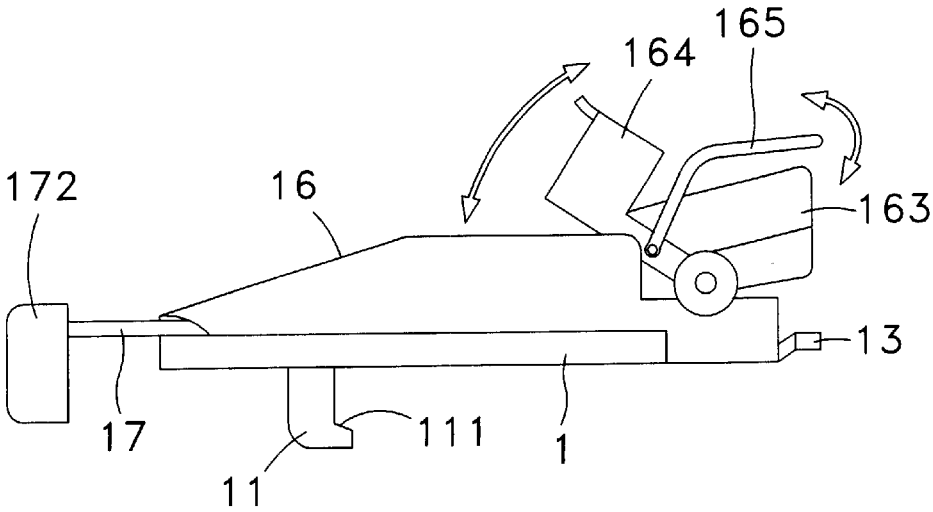
FIG. 3 is a front view taken from FIG. 1 of the present invention.

Wherein: the cover plate 1 is in the form of a bevel conical-like plate (as shown in FIGS. 1 to 3), and is provided on one end thereof with hooks 11 and 12 with oblique surfaces, and on the other end thereof with a plurality of tenons 13, 14; the cover plate 1 is also provided with a slot 15.

The housing 16 is slipped over the cover plate 1 (as shown in FIG. 1), it is coincident in contour with the cover plate 1; the housing 16 is provided with a recessed portion 161 (as shown in FIG. 6). The recessed portion 161 has therein a slot 162 and a protruding portion 163; the slot 162 is corresponding to the slot 15 on the cover plate 1. And the housing 16 is provided on one end thereof with an engaging plate 164 able to lay flat thereon, the engaging plate 164 can be hidden in the recessed portion 161; and the engaging plate 164 is pivotally connected with a 'U' shaped locking hoop 165 (referring to FIG. 3), the two lateral arm portions of the locking hoop 165 are both curved in order that the locking hoop 165 has a strong elastic restoring function when it is stretched.

The pusher rod 17 is in a 'U' shape to form a stop portion 171 (as shown in FIG. 6), the open end of the pusher rod 17 is slipped thereover with a plastic pad 172 on which there is a hole 173 exactly for passing of a fastener therethrough; the pusher rod 17 is extended between the cover plate 1 and the housing 16 in order that the stop portion 171 of the pusher rod 17 can straddle the slot 15 on the cover plate 1 (as shown in FIG. 2) and the slot 162 of the housing 16 (as shown in FIG. 6), and the pusher rod 17 can freely move between the cover plate 1 and the housing 16.

Figure 4:
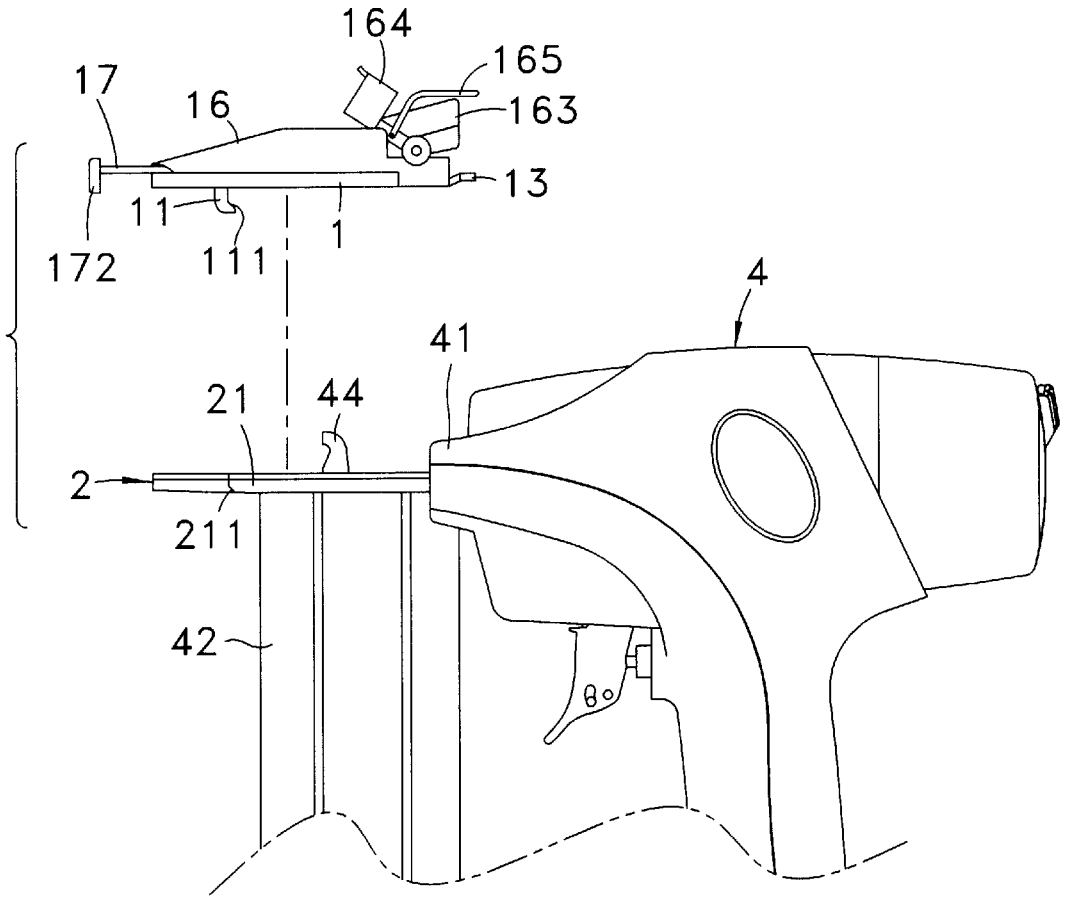
FIG. 4 is a front view showing operation of detachment of the present invention.
Figure 5:
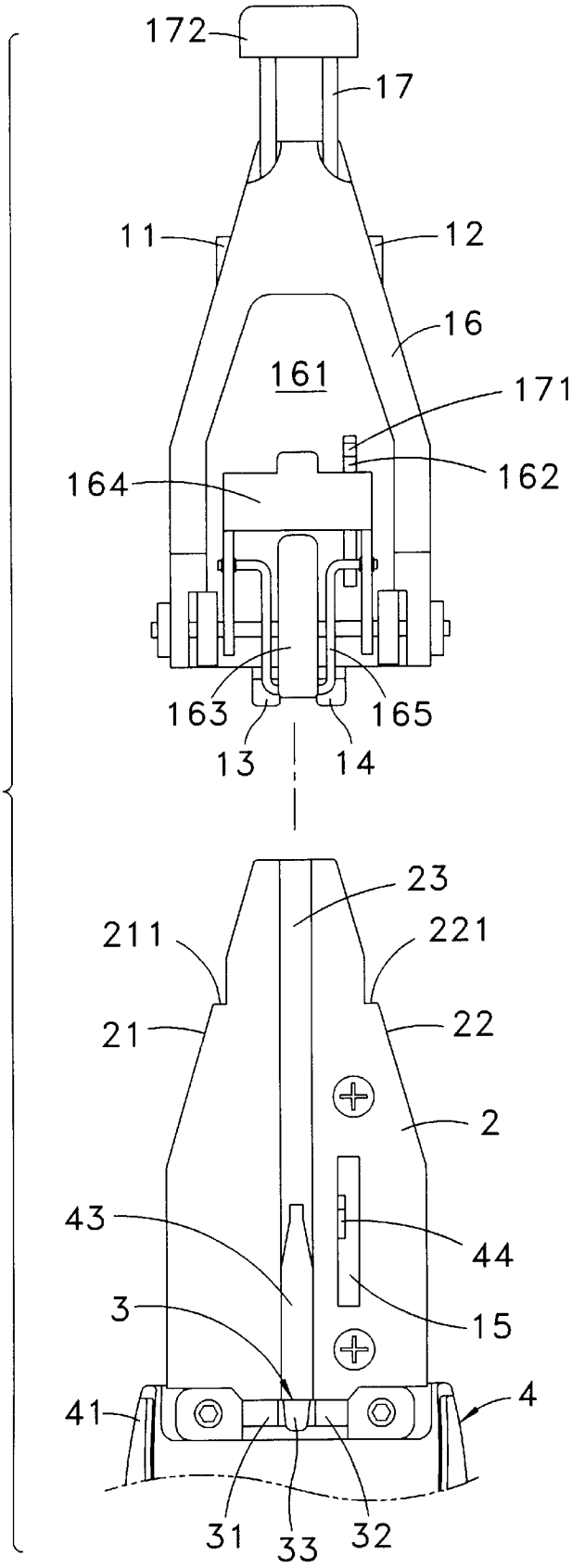
FIG. 5 is a bottom view showing operation of detachment of the present invention.

The guide plate 2 has thereon a hook seat 3 (as shown in FIG. 5), and is mounted between the head 41 and a fastener cartridge 42 of the fastening tool 4 (as shown in FIG. 4). The guide plate 2 is provided with a groove 23 to receive therein a fastener shooting rod 43 of the fastening tool 4. The front end of the guide plate 2 is provided with engaging portions 21, 22 having thereon oblique surfaces 211 and 221 respectively (as shown in FIG. 5); the engaging portions 21, 22 correspond in position to the hooks 11 and 12 on the cover plate 1, so that the hooks 11 and 12 on the cover plate 1 can be engaged with the engaging portions 21, 22 of the guide plate 2. And the guide plate 2 is provided with a safe slide rod 44 of the fastening tool 4 protruding from the guide plate 2 (as shown in FIG. 4); the safe slide rod 44 can be simultaneously extended in the slot 15 on the cover plate 1 and the slot 162 of the housing 16, so that it can press against the stop portion 171 of the pusher rod 17 to render the pusher rod 17 to operate synchronically with the safe slide rod 44.

Figure 7:
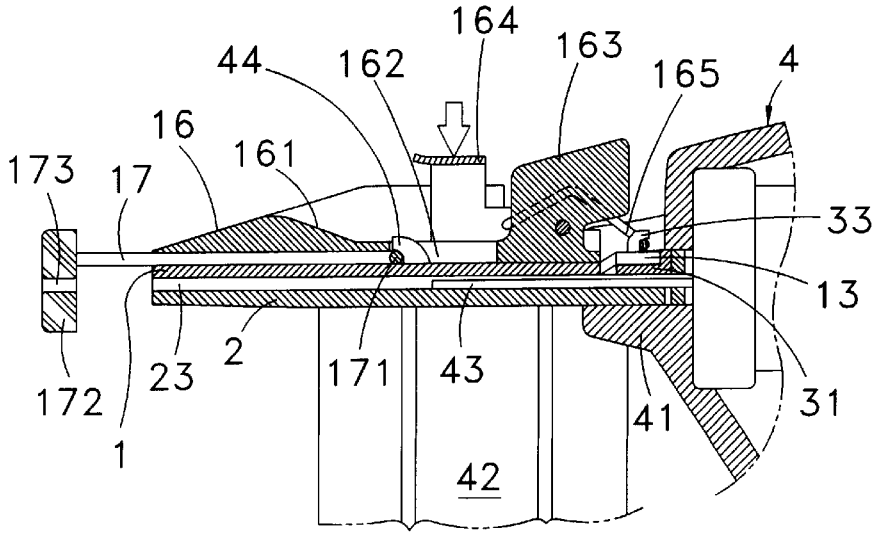
FIG. 7 is a sectional view showing use of the present invention.

The hook seat 3 is locked between the head 41 of the fastening tool 4 and the guide plate 2 (as shown in FIG. 5), and is provided thereon with a back hook 33 and slide grooves 31, 32 which can exactly receive the tenons 13, 14 of the cover plate 1, and the back hook 33 can engage the locking hoop 165 of the housing 16 (as shown in FIG. 7). By the above combination, a quick detachable fastener cover structure is formed.

Figure 8:
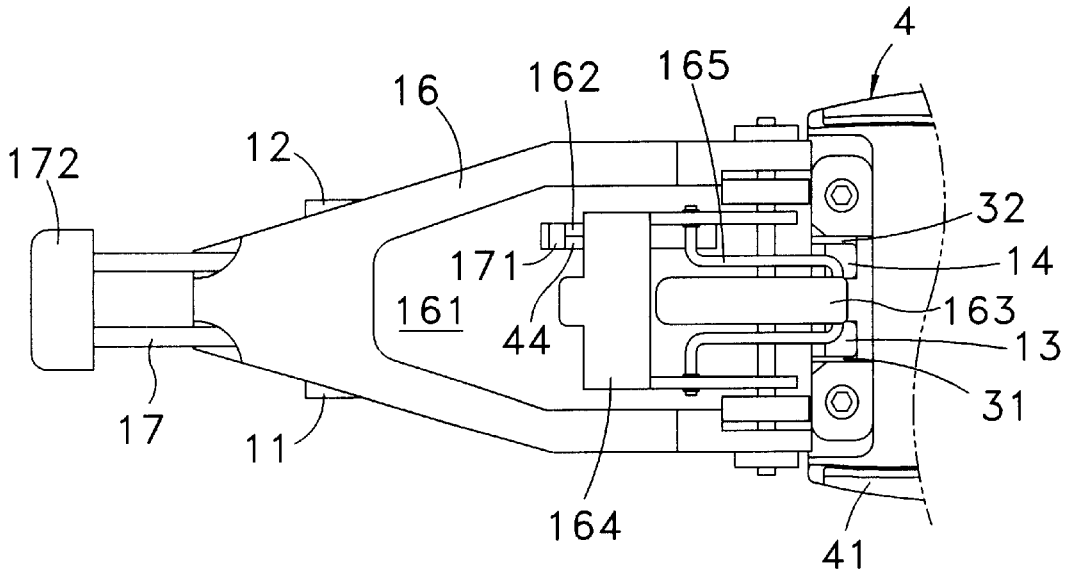
FIG. 8 is a bottom view taken from FIG. 7 of the present invention.

When the fastening tool 4 is used, the cover plate 1 clings to the guide plate 2 of the fastening tool 4 and is moved downwardly from above (referring to FIGS. 4 and 5) till the safe slide rod 44 is extended in the slot 15 on the cover plate 1 and the slot 162 of the housing 16 and abuts against the stop portion 171 of the pusher rod 17 (as shown in FIG. 6) to push the cover plate 1 and render the protruding portion 163 on the housing 16 to cover the back hook 33 of the hook seat 3, and to render the tenons 13, 14 of the cover plate 1 to synchronically engage the engaging portions 21, 22 of the guide plate 2. Thereby, the cover plate 1 is tightly engaged with the guide plate 2, at this time, the 'U' shaped locking hoop 165 engages in the back hook 33 of the hook seat 3 (referring to FIG. 6), and the engaging plate 164 is rotationally pressed down to be laid flat on the surface of the housing 16 to pull the 'U' shaped locking hoop 165 to render the latter to be pulled and stretched simultaneously in two mutual opposite directions by the back hook 33 and the engaging plate 164. By the strong elasticity endued, the locking hoop 165 can simultaneously pull the cover plate 1 and the housing 16 (referring to FIG. 7), so that the tenons 13, 14 of the cover plate 1 and the hooks 11, 12 can tightly press and engage the engaging portions 21, 22 of the guide plate 2 and the slide grooves 31, 32 of the hook seat 3; thereby, the cover plate 1 and the guide plate 2 can be fast and tightly connected with each other (referring to FIG. 8). In this way, a track can be formed between the groove 23 on the guide plate 2 and the cover plate 1 to exactly receive a single fastener and the fastener shooting rod 43; and thereby, the fastener can be sent through the track by means of the fastener shooting rod 43 for shooting, and a shooting port of the fastening tool 4 is formed for shooting fasteners.

When the fastening tool 4 happens to be jammed by virtue of rusting, it needs only to reversely move the engaging plate 164 to loosen the locking hoop 165 to make the latter be moved by the engaging plate 164 to push the head 41 of the fastening tool 4 and to move the cover plate 1; thereby, the hooks 11, 12 and the tenons 13, 14 of the cover plate 1 can respectively get released from the engaging portions 21, 22 of the guide plate 2, and in turn the locking hoop 165 can automatically get released from hooking of the back hook 33; now, a user needs only to lightly raise the cover plate 1 to have it easily ad quickly released from the fastening tool 4, thereby, the guide plate 2 of the fastening tool 4 completely exposes in favor of removing the jamming fasteners.

One thing is especially worth mentioning, by the elastic function of the abovementioned locking hoop 165 in cooperation with the hooks 11, 12 and the tenons 13, 14 of the cover plate 1 to respectively tight press and engage the engaging portions 21, 22 of the guide plate 2 and the slide grooves 31, 32 of the hook seat 3, the cover plate 1 and the guide plate 2 can be engaged and tightly connected with each other. This can simplify the complication of the quick detaching components. And the hooks 11,12 of the cover plate 1 and the engaging portions 21, 22 of the guide plate 2 are all designed to forcedly mutual engage by means of oblique surfaces, tightness of connection between the cover plate 1 and the guide plate 2 is thereby increased, and rate of fault of the fastening tool 4 can be lowered. Besides, the locking hoop 165 and the engaging plate 164 are both hidden in the housing 16 (referring to FIG. 1), so that the structure of the cover plate 1 can have smooth surfaces; in addition to have the advantages of preventing dust and increasing esthetic appearance, it renders the user to get a larger field of view for smooth operation during shooting fasteners. And when the fastening tool 4 moves fast or drops inadvertently, the engaging plate 164 on the housing 16 will not be touched, and thereby inadvertent loosening of the cover plate 1 can be effectively gotten rid of; besides, the protruding portion 163 on the housing 16 can also protect the locking hoop 165 and the back hook 33 from collision, the fastening tool 4 thereby is safe in use.

The embodiment cited above is not for giving any limitation to the scope of the present invention. It will be apparent to those skilled in this art that various modifications or changes made without departing from the spirit and scope of this invention shall also fall within the scope of the appended claims and are intended to form part of this invention.

What is claimed is:

1. A quick detachable fastener cover structure for a fastening tool comprising a cover plate, a housing, a guide plate and a hook seat, wherein:

said cover plate is provided on one end thereof with hooks having oblique surfaces, and on the other end thereof with a plurality of tenons;

said housing is fixed on said cover plate, and is provided on one end thereof with an engaging plate able to lay flat thereon, and is pivotally connected with a 'U' shaped locking hoop;

said guide plate is mounted between a head and a fastener cartridge of said fastening tool, and is provided on one end thereof with engaging portions having thereon oblique surfaces, said engaging portions correspond in position to said hooks on said cover plate;

said hook seat is mounted between said head of said fastening tool and said guide plate, and is provided thereon with slide grooves and a back hook to respectively receive said tenons and engage said locking hoop;

by combination the above components, a quick detachable fastener cover structure is formed of which said cover plate and said guide plate are adapted to fast and tight connecting with each other in a easy way.

2. A quick detachable fastener cover structure for a fastening tool as claimed in claim 1, wherein, a pusher rod is extended between said cover plate and said housing, and a safe slide rod is provided on and protruding from said guide plate to press against said pusher rod.

3. A quick detachable fastener cover structure for a fastening tool as claimed in claim 2, wherein, said cover plate and said housing each is provided with a slot in order that said safe slide rod simultaneously extends in said slots to press against said pusher rod to render said pusher rod to operate synchronically with said safe slide rod.

4. A quick detachable fastener cover structure for a fastening tool as claimed in claim 1, wherein, said housing is provided with a recessed portion to hide therein said engaging plate.

5. A quick detachable fastener cover structure for a fastening tool as claimed in claim 1, wherein, said housing is provided with a protruding portion to protect and hold said back hook and said 'U' shaped locking hoop.

* * * * *